US011535497B2

(12) United States Patent
Edler et al.

(10) Patent No.: US 11,535,497 B2
(45) Date of Patent: Dec. 27, 2022

(54) HYDRAULIC ROTARY DRIVE

(71) Applicant: Schwing GmbH, Herne (DE)

(72) Inventors: Jörg Edler, Köflach (AT); Daniel Kriegl, Rosenthal (AT); Manuel Josef Ulbing, Graz (AT)

(73) Assignee: SCHWING GMBH, Herne (DE)

( * ) Notice: Subject to any disclaimer, the term of this patent is extended or adjusted under 35 U.S.C. 154(b) by 262 days.

(21) Appl. No.: 16/956,089

(22) PCT Filed: Dec. 21, 2018

(86) PCT No.: PCT/EP2018/086461
§ 371 (c)(1),
(2) Date: Jun. 19, 2020

(87) PCT Pub. No.: WO2019/122280
PCT Pub. Date: Jun. 27, 2019

(65) Prior Publication Data

US 2020/0391982 A1 Dec. 17, 2020

(30) Foreign Application Priority Data

Dec. 22, 2017 (AT) ..... A51082/2017

(51) Int. Cl.
*B66C 23/68* (2006.01)
*F15B 15/28* (2006.01)
(Continued)

(52) U.S. Cl.
CPC ..... *B66C 23/68* (2013.01); *B66C 23/00* (2013.01); *E04G 21/04* (2013.01); *F15B 15/06* (2013.01); *F15B 15/2807* (2013.01)

(58) Field of Classification Search
CPC ..... F15B 15/2861; F15B 15/2815; F15B 2211/6336; F15B 15/2807; E04G 21/04; E04G 21/0445
See application file for complete search history.

(56) References Cited

U.S. PATENT DOCUMENTS

2015/0299986 A1 10/2015 Ikegami et al.

FOREIGN PATENT DOCUMENTS

EP 1391615 A2 * 2/2004 ..... F15B 15/2807
EP 2776360 B1 2/2016
(Continued)

OTHER PUBLICATIONS

International Search Report and Written Opinion issued in PCT/EP2018/086461, dated Apr. 18, 2019 (English translation); 7 pages.

*Primary Examiner* — Thomas E Lazo
*Assistant Examiner* — Daniel S Collins
(74) *Attorney, Agent, or Firm* — Faegre Drinker Biddle & Reath LLP

(57) ABSTRACT

A hydraulic rotary drive includes a first rotary drive element and at least two annular pistons connected to the first rotary drive element in a rotationally fixed manner and configured to be axially movable on the first rotary drive element between two end positions. Each annular piston has two annular spur serrations directed away from one another. The hydraulic rotary drive includes a second rotary drive element with ring type serrations that are complementary to the spur serrations of the annular pistons. The hydraulic rotary drive includes a control unit that is configured to control supply of hydraulic fluid to the annular pistons to cause a reciprocating movement of the annular pistons on a shaft in accordance with an operating signal. The hydraulic rotary drive includes a sensor arrangement communicatively coupled to the control unit and arranged to detect the positions of the annular pistons along respective sliding paths.

16 Claims, 20 Drawing Sheets

Figure 1:
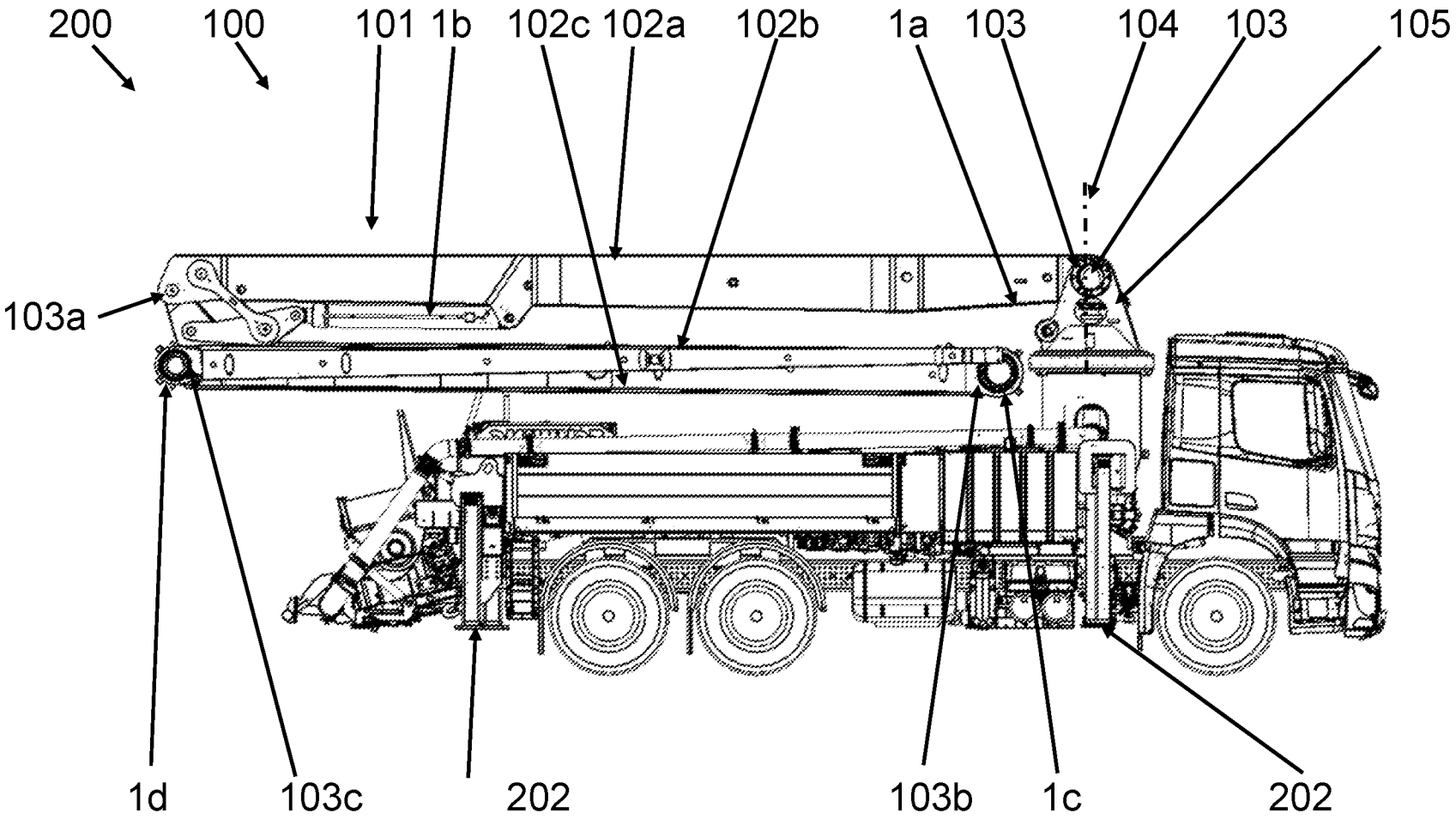

(51) Int. Cl.

| | |
|---|---|
| ***B66C 23/00*** | (2006.01) |
| ***E04G 21/04*** | (2006.01) |
| ***F15B 15/06*** | (2006.01) |

(56) References Cited

FOREIGN PATENT DOCUMENTS

| | | | |
|---|---|---|---|
| FR | 2907869 | A1 | 5/2008 |
| WO | 2016181700 | A1 | 11/2016 |

* cited by examiner

HYDRAULIC ROTARY DRIVE

CROSS-REFERENCE TO RELATED APPLICATION

This application is a U.S. 371 national stage application of International Application No. PCT/EP2018/086461, filed 21 Dec. 2018, which claims priority to Austrian Patent Application No. A51082/2017, filed 22 Dec. 2017, both of which are herein incorporated by reference in their entireties.

The invention relates to a hydraulic rotary drive with a first rotary drive element, at least two annular pistons connected to the first rotary drive element in a rotationally fixed manner and axially movable on the first rotary drive element between in each case two end positions along a sliding path by being acted upon by a hydraulic fluid, each annular piston having two annular spur serrations directed away from one another, a second rotary drive element with ring type serrations complementary to the spur serrations of the annular pistons, whereby the spur serrations of the annular pistons are engageable and disengageable with the associated annular ring type serrations of the second rotary drive element by moving the annular pistons on the first rotary drive element, thereby causing a rotary movement of said second rotary drive element relative to said first rotary drive element, and a control unit which controls the supply of hydraulic fluid to the annular pistons, wherein the control unit is arranged to cause a reciprocating movement of the annular pistons on the shaft in accordance with an operating signal. Further the invention relates to a large manipulator with such a rotary drive and a truck mounted concrete pump with such a large manipulator.

A corresponding rotary drive is known from EP 2 776 360 B1. To control the drive described here, a mechanical control by means of a control disc is proposed, which controls the switching pulses for the hydraulic valves for the supply of the hydraulic fluid to the two annular pistons. Such a mechanical control is disadvantageous, because it cannot control the change-over phase so precisely that the engagement position of the interacting spur serrations can be set reliably. On the one hand, this can lead to an early engagement of the teeth and thus to a transmission of force at the tooth tips, although the tooth tips are not suitable to transmit correspondingly high acting forces. On the other hand, the moment of load transfer between the annular pistons is not clearly defined, making it difficult to achieve uniformity of rotation, especially under load.

Against this background, the task of the invention is to provide an improved rotary drive which offers improved control of the reciprocating motion of the annular pistons by supplying the annular pistons with the hydraulic fluid. In particular, the uniformity of the rotary motion shall be improved and damage to the tooth tips of the spur serrations of the annular pistons and the complementary ring type serrations shall be avoided.

The invention solves this problem starting from a hydraulic rotary drive of the type mentioned above by providing a sensor arrangement connected to the control unit is for detecting the positions of the annular pistons along the respective sliding path. With the exact detection of the position of the annular pistons along the respective sliding path, the control unit can control the supply of hydraulic fluid to the annular pistons, and thus also their speed, in a more targeted manner in order to generate a controlled reciprocating movement of the annular pistons on the shaft, thereby improving the uniformity of the rotary movement of the rotary drive and also preventing damage to the tooth tips of the spur serrations, to the annular pistons and to the complementary annular serrations.

Advantageous embodiments and further developments of the invention result from the dependent claims. It should be pointed out that the features individually listed in the claims can also be combined with each other in any technologically meaningful way and thus show further embodiments of the invention.

According to an advantageous embodiment of the invention, it is provided that the sensor arrangement is designed to detect the positions of the annular pistons when the respective end position is reached. With the detection of the annular piston position when the respective end position is reached, a simple possibility is given with the sensor arrangement to detect the position of the annular pistons along the sliding path at least in the end position, whereby the control unit can be enabled to control the switch-over phase for a back and forth movement of the annular pistons.

An advantageous embodiment is that the sensor arrangement includes at least one switch that switches when the respective annular piston reaches a predetermined position. With a simple switch, the reaching of the piston at a predetermined position can be reliably detected, so that the control device can initiate the changeover phase in a targeted manner by supplying the annular piston with the hydraulic fluid.

A preferred embodiment is that the switch is designed as an inductive limit position switch. With an inductive limit position switch, a reliable and low-wear option is available for detecting the position of the annular pistons along the sliding path when a predetermined position is reached.

In a further preferred embodiment it is provided that the sensor arrangement comprises at least one displacement sensor which detects the instantaneous position of at least one annular piston along the sliding path. With the detection of the instantaneous position of at least one annular piston via a displacement sensor, the speed of the reciprocating movement of the annular pistons at the first rotary drive element in particular can be set particularly accurately by the control unit, since the hydraulic fluid can be applied to the annular pistons depending on the instantaneous position of the annular piston along the sliding path. This allows the speed of the piston movement to be controlled over the entire position of each annular piston, so that in particular the load transfer from one annular piston to the other can be defined by different piston speeds, which considerably improves the uniformity of the rotary movement.

It is particularly advantageous that the displacement sensor is designed for inductive detection. An inductive displacement sensor provides a particularly low-wear option for detecting the current position of the annular piston along the sliding path.

Further advantageous is the design of the displacement sensor with capacitive detection. A capacitive displacement sensor provides a particularly low-wear and insensitive means of detecting the current position of the annular piston along the sliding path.

Further advantageous is the embodiment that the displacement sensor has an annular electrode insulated from a rotary drive element, preferably the second rotary drive element, into which at least a section of the annular piston detected by the displacement sensor is immersed to different depths during displacement along the sliding path. With such a ring electrode insulated with respect to a rotary drive element, preferably the second rotary drive element, it is very easy to ensure capacitive detection of the instantaneous position of the annular piston. This is done by immersing at least a section of the annular piston to different depths in the insulated annular electrode when it is moved along the sliding path. Depending on the immersion depth of the section in the area of the ring electrode, a changed capacitance can be measured at the ring electrode. The ring electrode is insulated against a rotary drive element, preferably the second rotary drive element, preferably by a plastic ring. In addition, an air gap may be formed between the immersing portion of the annular piston and the annular electrode to provide insulation of the annular electrode from the immersing portion.

In a further preferred embodiment, it is intended that the displacement sensor includes a strain gauge which provides a signal dependent on the instantaneous position of at least one annular piston along the sliding path. The instantaneous position of at least one annular piston along the sliding path can be detected particularly easily with a strain gauge. Preferably, the strain gauge is mounted on a preloaded bending spring which engages the at least one annular piston to detect its instantaneous position. Due to the preload of the bending spring, it can remain in engagement with the annular piston. The resistance of the strain gauge changes when the bending of the bending spring changes, so that the momentary position of the annular piston can be detected along the sliding path. The pretensioned bending spring can either act with one end on the piston shoulder of the annular piston or be guided in a groove on the piston.

An advantageous embodiment of the invention provides that the displacement sensor is arranged outside an external rotary drive element, preferably outside the second rotary drive element. With the arrangement of the displacement sensor outside the outer rotary drive element, an easily accessible displacement sensor can be specified for the sensor arrangement. In addition, the outer rotary drive element can be made smaller by arranging the displacement sensor outside, so that more installation space is available for the annular pistons.

A preferred embodiment provides that the displacement sensor of the sensor assembly is located in an additional housing, which is arranged on the outside of the outer rotary drive element, preferably outside the second rotary drive element. With an additional housing outside the outer rotary drive element, the displacement sensor can be arranged in a protected and yet easily accessible position. This facilitates maintenance work and further reduces errors caused by external influences such as moisture and dirt.

Further advantageous is an embodiment where the displacement sensor uses a sensing rod to detect the instantaneous position of the at least one annular piston along the sliding path in the outer rotary drive element, preferably in the second rotary drive element, the sensing rod being guided through a feedthrough into the outer rotary drive element, preferably into the second rotary drive element. With the proposed sensing rod, which is guided through the passage into the outer rotary drive element, preferably into the second rotary drive element, the instantaneous position of the annular piston along the sliding path can be sensed in a simple manner and detected by sensors outside the outer rotary drive element, preferably outside the second rotary drive element.

It is particularly advantageous that the sensing rod is in engagement with at least one annular piston. In order to be able to reliably detect the current position of the annular piston via a displacement sensor arranged outside, the outer rotary drive element, preferably outside the second rotary drive element, the sensing rod is in engagement with the annular piston. For this purpose, the sensing rod can either engage with one end on the piston shoulder of the annular piston or be guided in a groove on the piston.

An advantageous embodiment is that the control unit regulates the speed of the annular pistons depending on the signals of the sensor arrangement. With a control unit designed in this way, in particular the switching phase of the reciprocating movement of the annular pistons can be precisely controlled so that, when the load is transferred, the load on the tooth tips of the ring type serrations and the spur type serrations is reduced and the speed of the two annular pistons relative to each other can be adjusted so that a defined load transfer takes place, which ensures the uniformity of the rotary movement of the drive. With the invention's control of the speed of the annular pistons, defined positions of the annular pistons can also be adjusted at the right time in order to further improve the load transfer behavior between the serrations.

A preferred embodiment of the invention provides that the first rotary drive element is designed as a shaft and the second rotary drive element is designed as a cylinder housing, the annular pistons being axially movable on the shaft between the respective two end positions along the sliding path by being acted upon by the hydraulic fluid. A further preferred embodiment of the invention provides that the cylinder housing forms the outer rotary drive element.

Furthermore, the object of the invention is a large manipulator, wherein the large manipulator described before and in more detail below has an articulated boom comprising two or more boom sections, wherein the boom sections are connected to the respective adjacent boom section in a pivotally movable manner via articulated joints by means of one drive each, wherein at least one of the drives is designed as a rotary drive according to the invention. A large manipulator designed in this way can be swivelled particularly flexibly by means of an articulated boom with such a rotary drive, so that the articulated boom can be brought into very special unfolding forms. This makes its use flexible. The specially designed rotary drive also offers a long service life and low wear.

Furthermore, the object of the invention is a truck-mounted concrete pump, whereby the truck-mounted concrete pump already described above and in more detail below has a large manipulator carrying a concrete conveying line, as already described above and in more detail below. With such a large manipulator on a truck-mounted concrete pump, the concrete can be distributed on the construction site particularly easily and flexibly.

Figure 2:
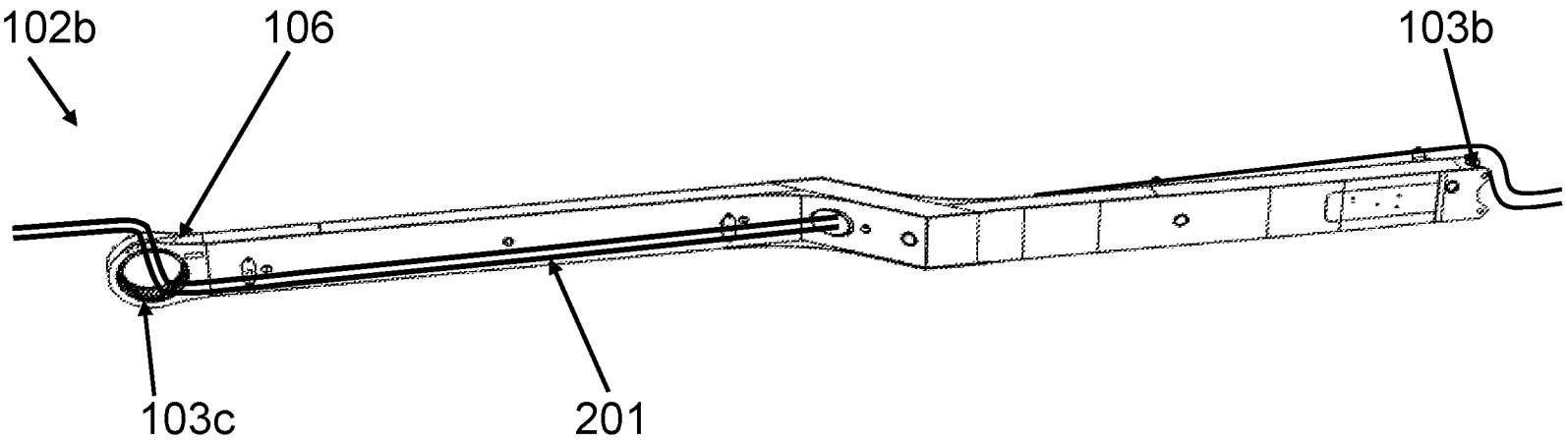
Figure 3:
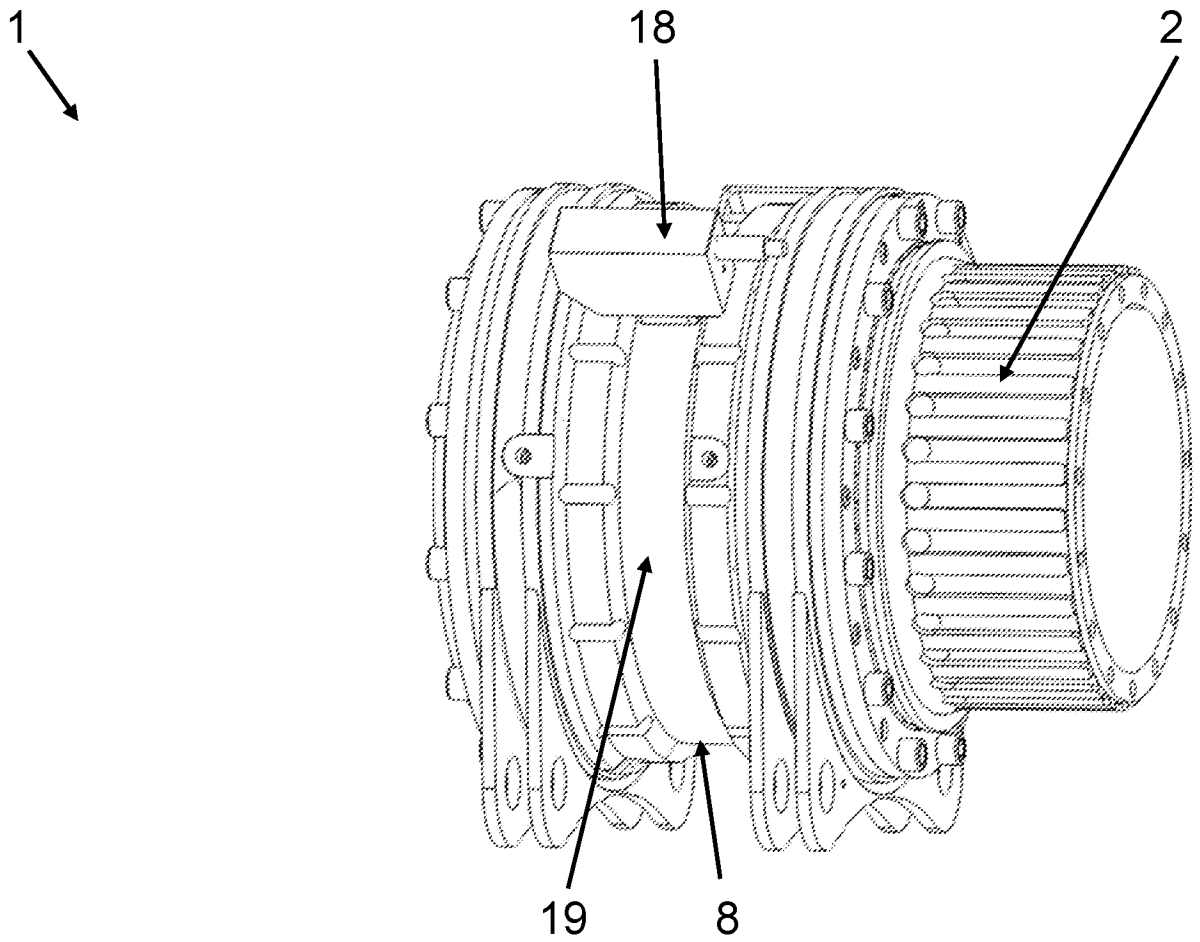
Figure 4:
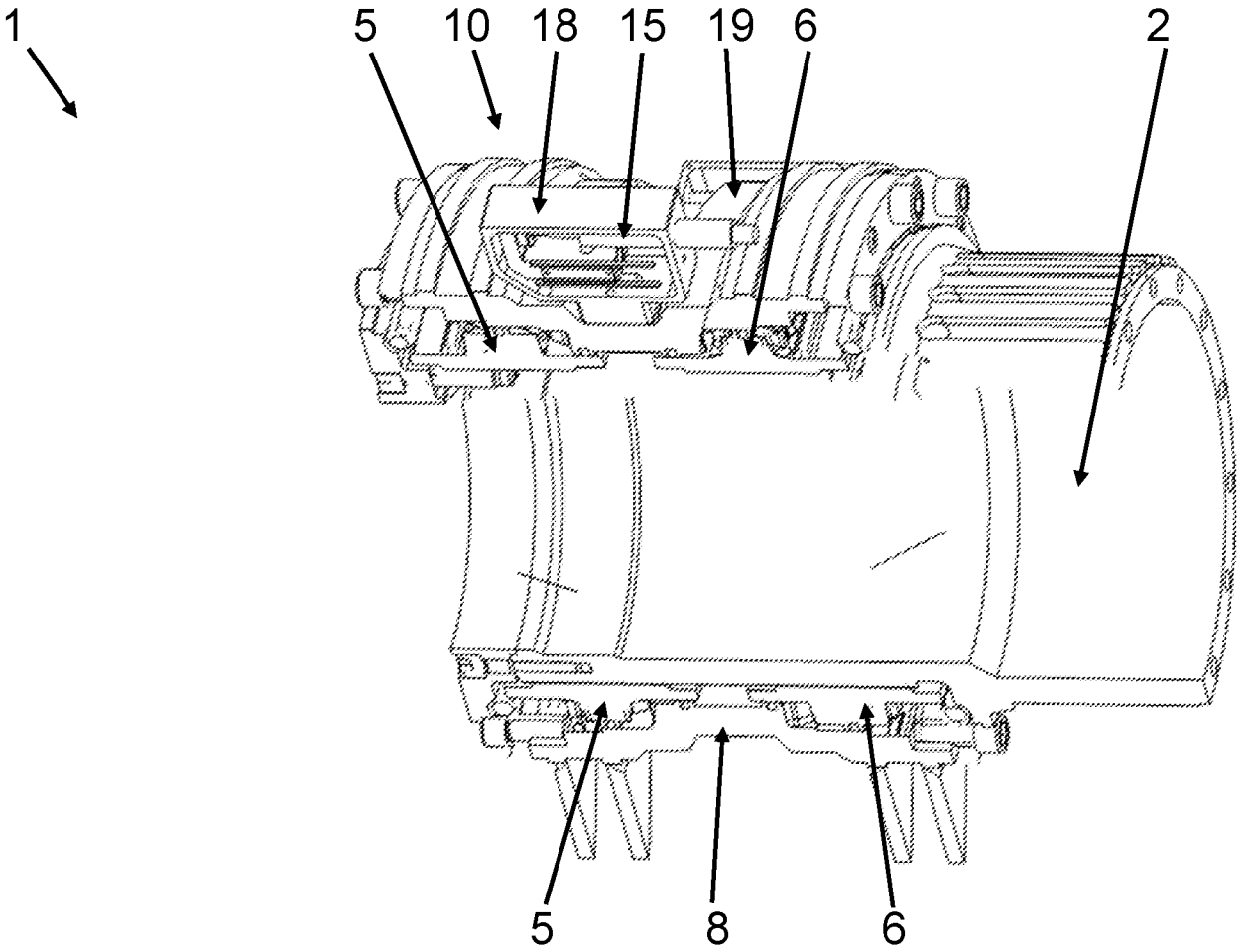
Figure 5:
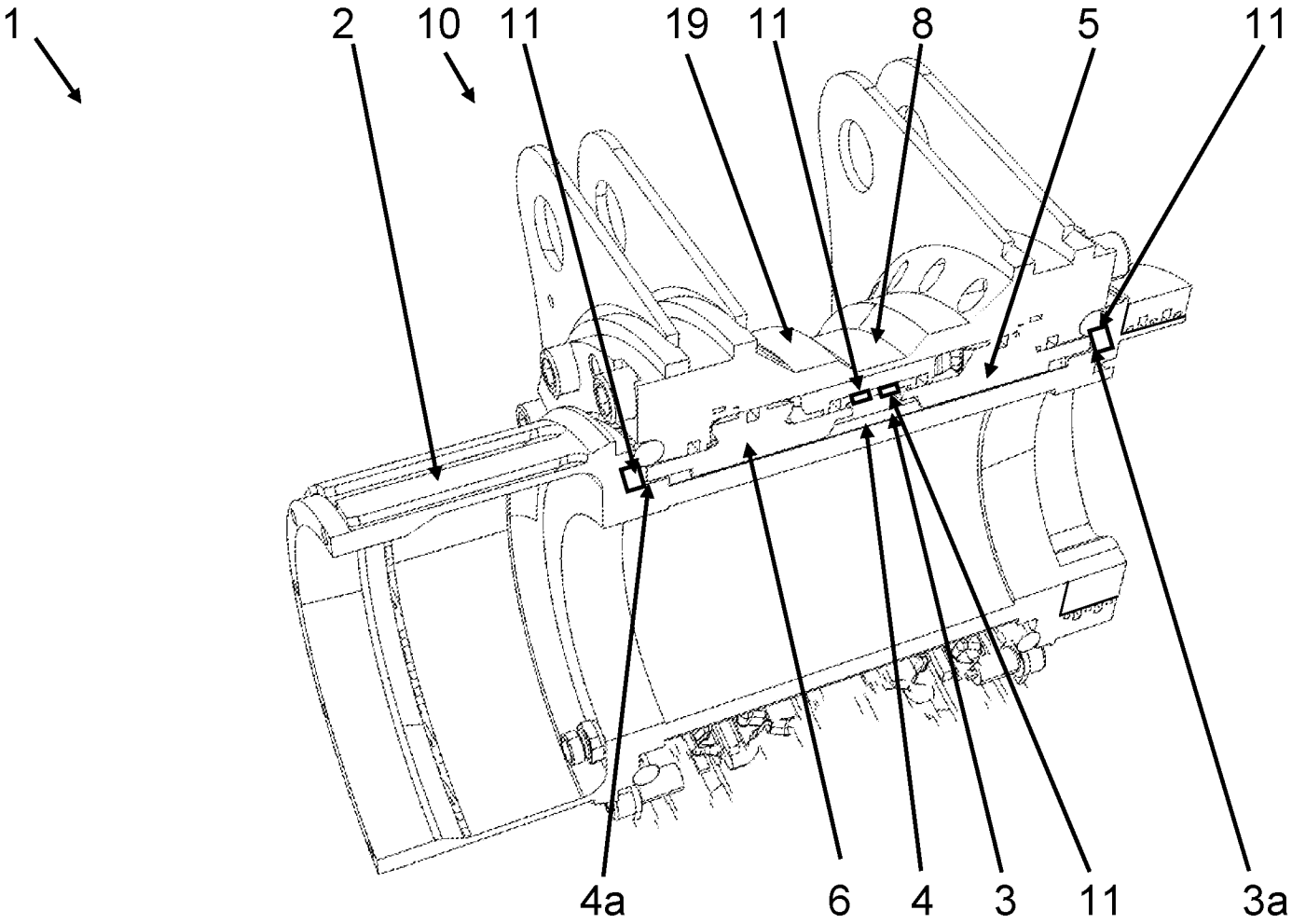
Figure 6:
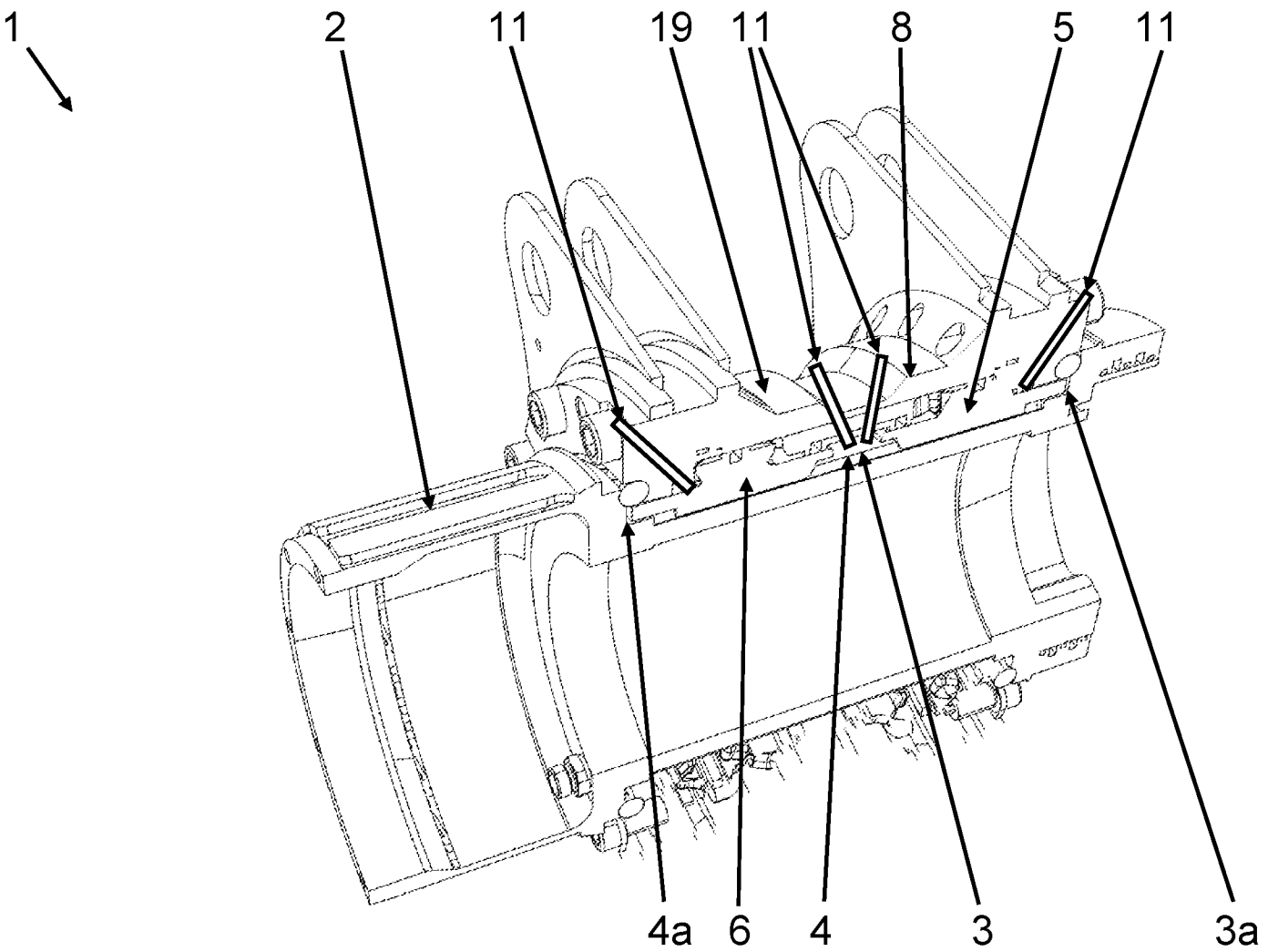
Figure 7:
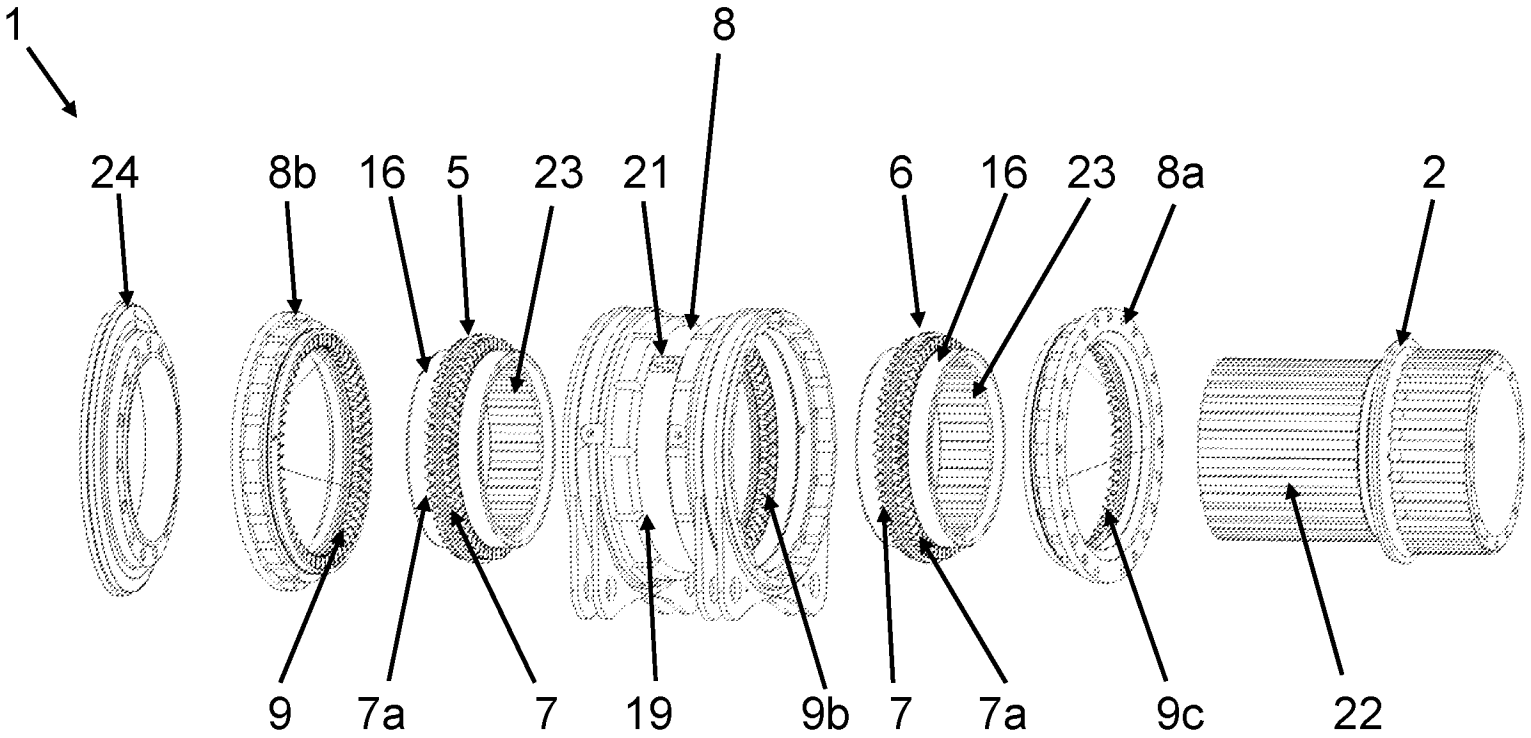
Figure 8:
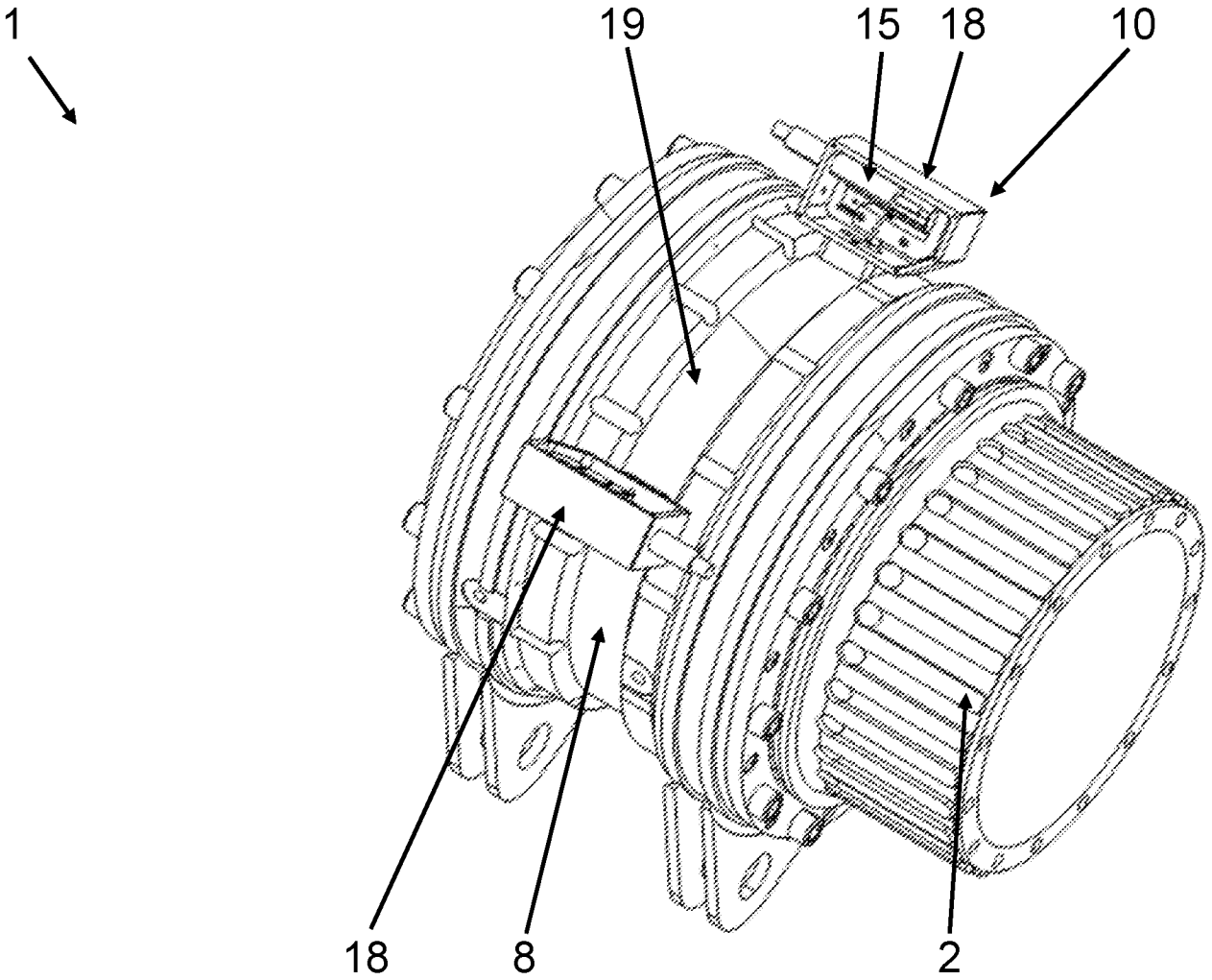
Figure 9:
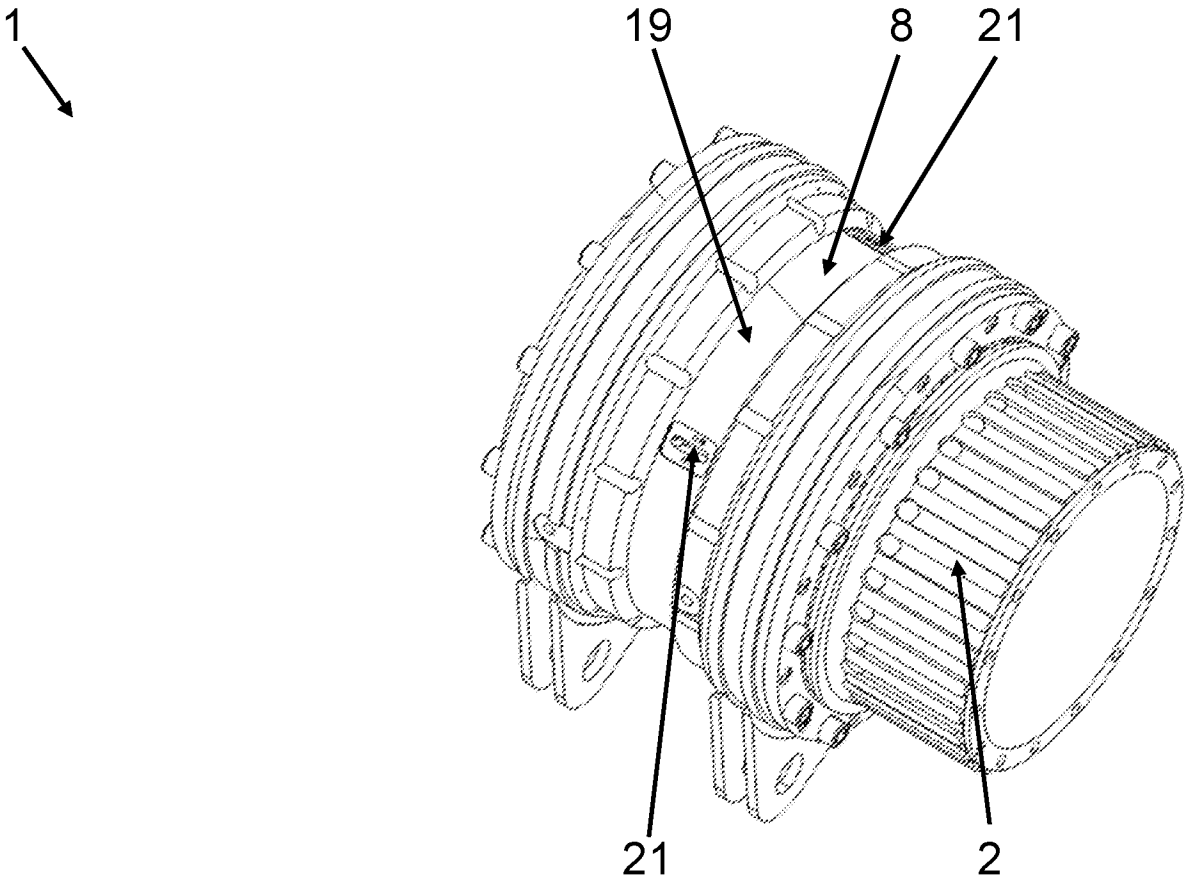
Figure 10:
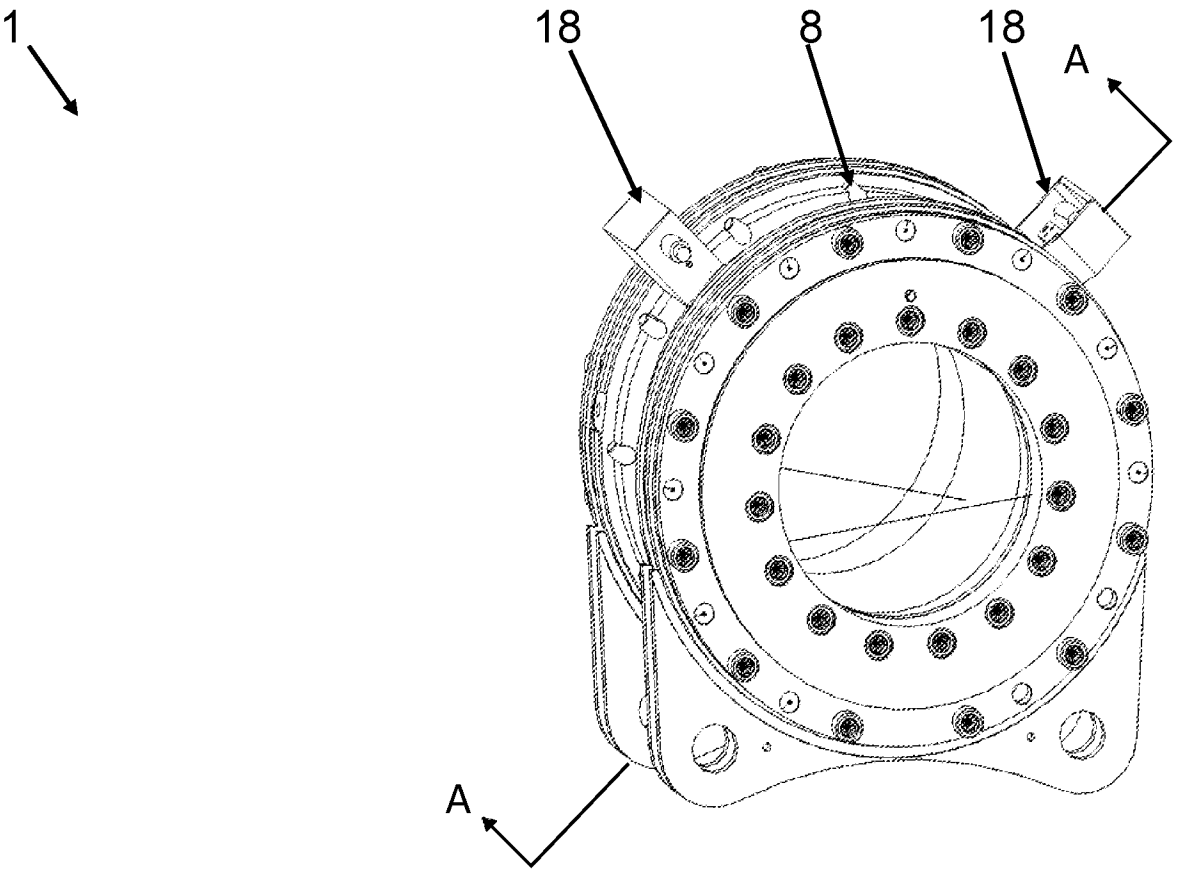
Figure 11:
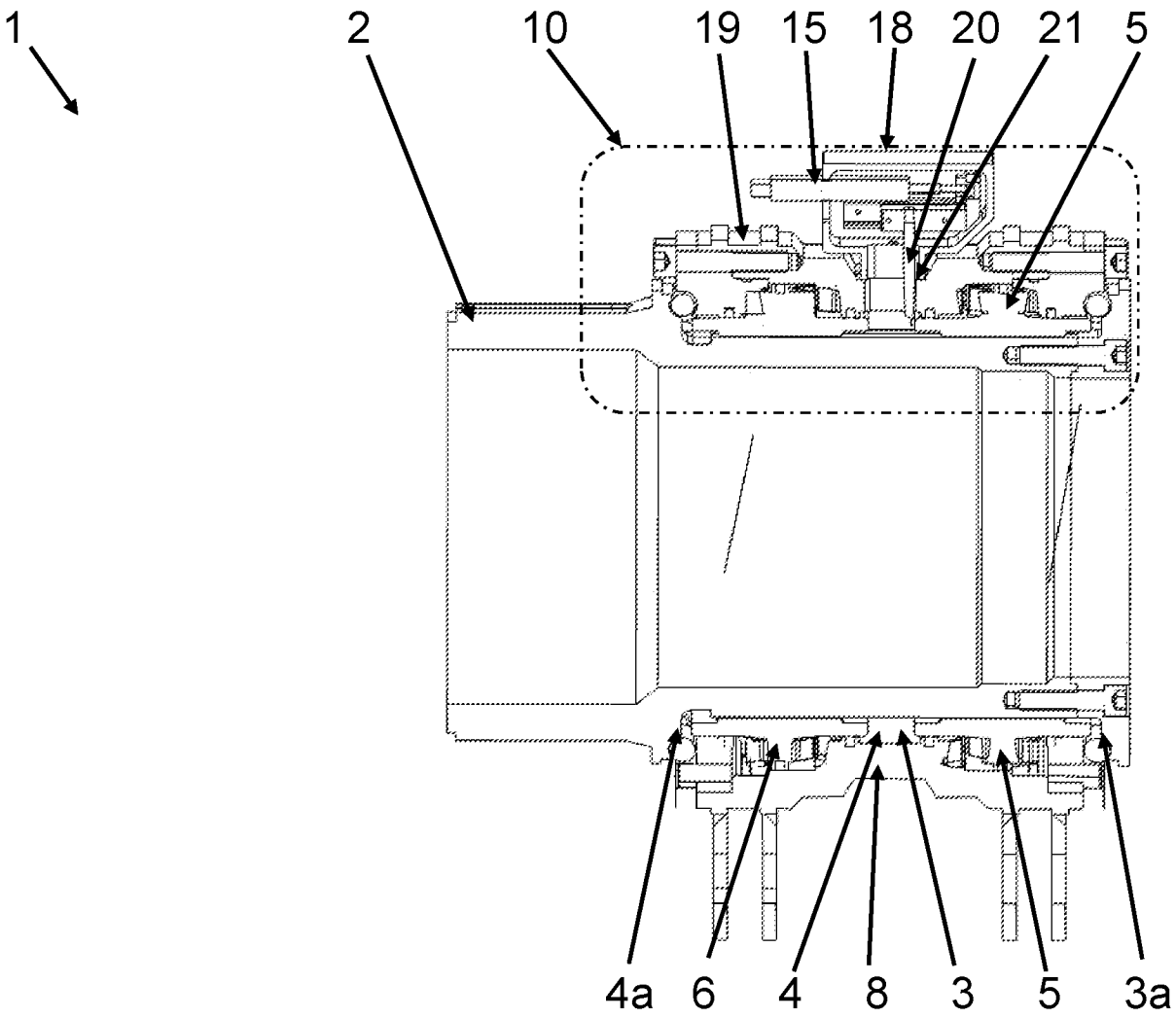
Figure 12:
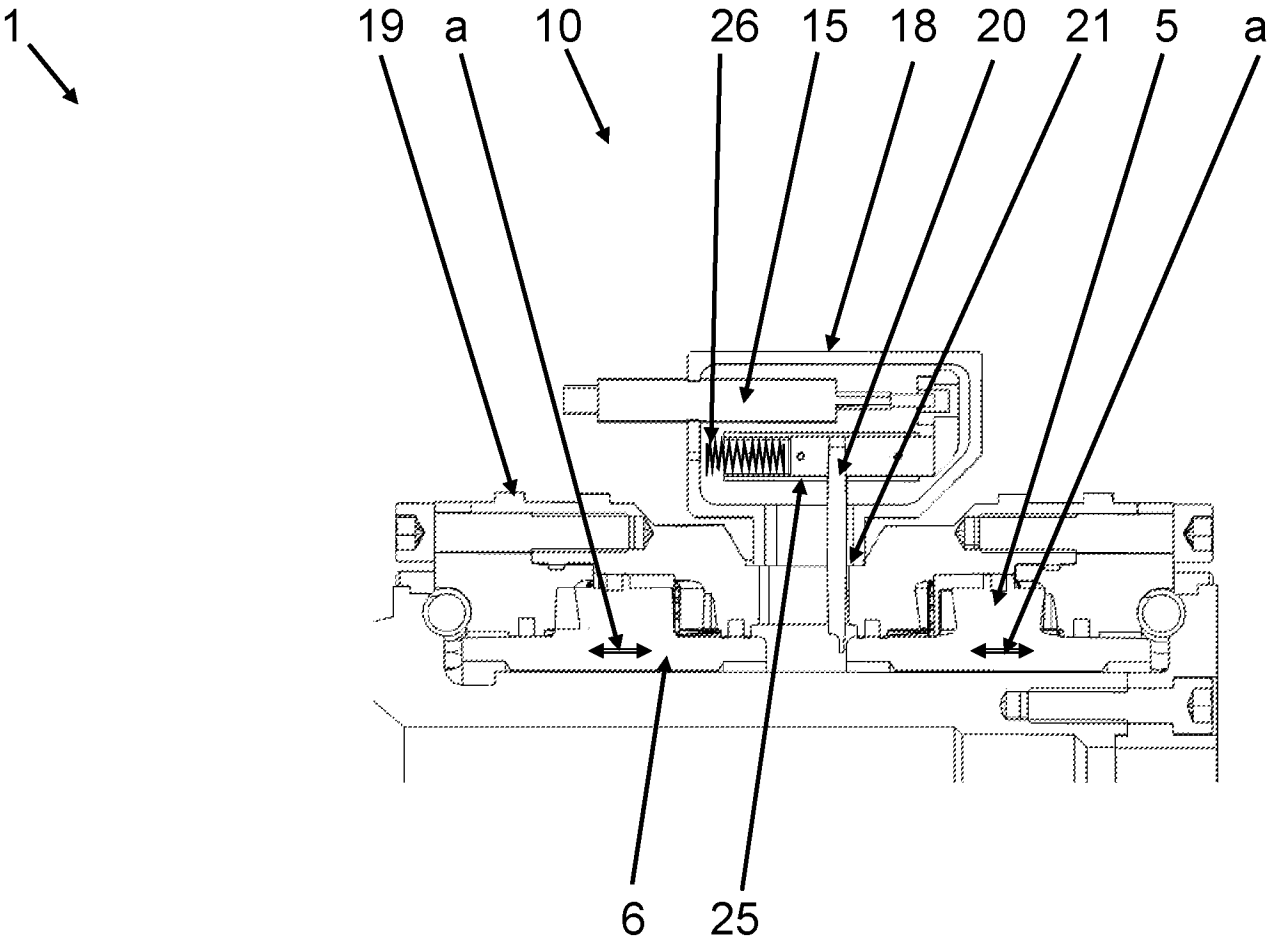
Figure 13:
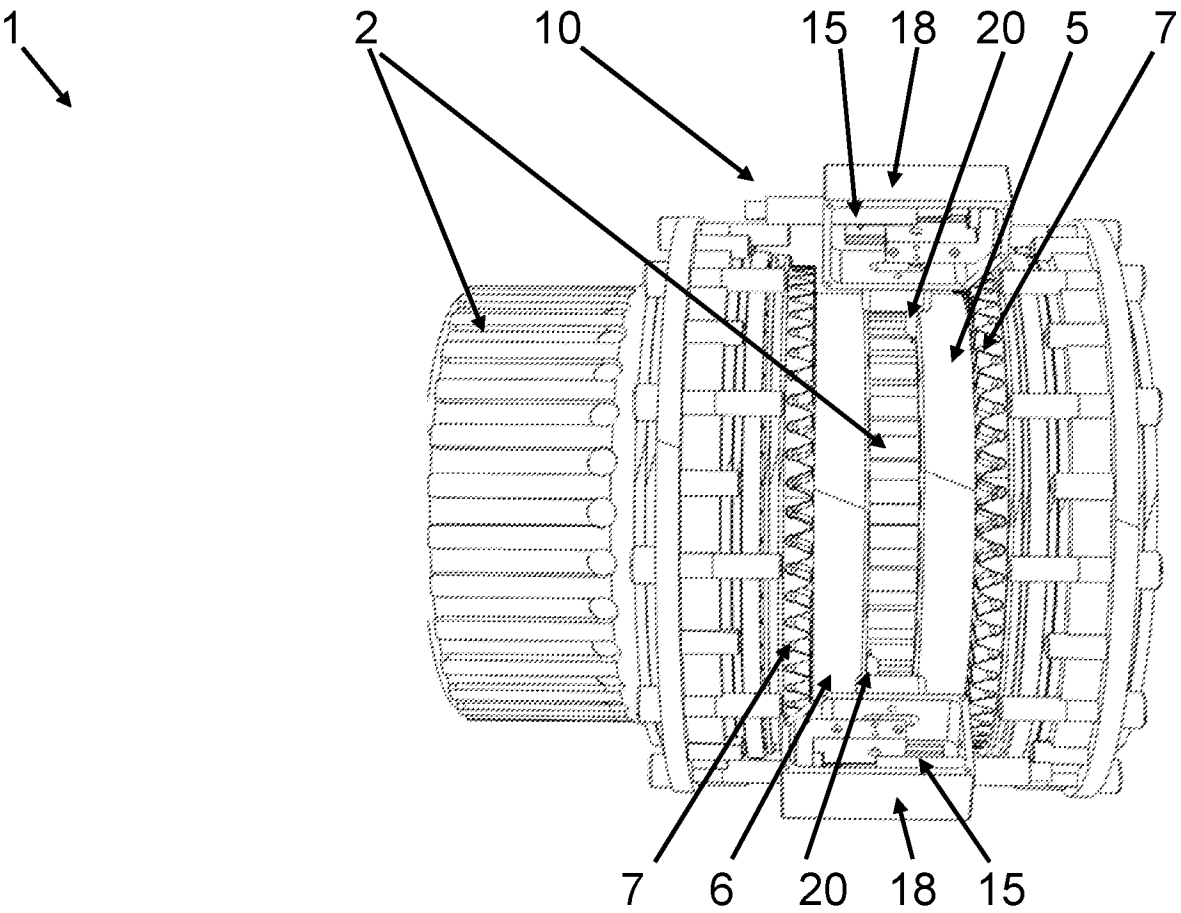
Figure 14:
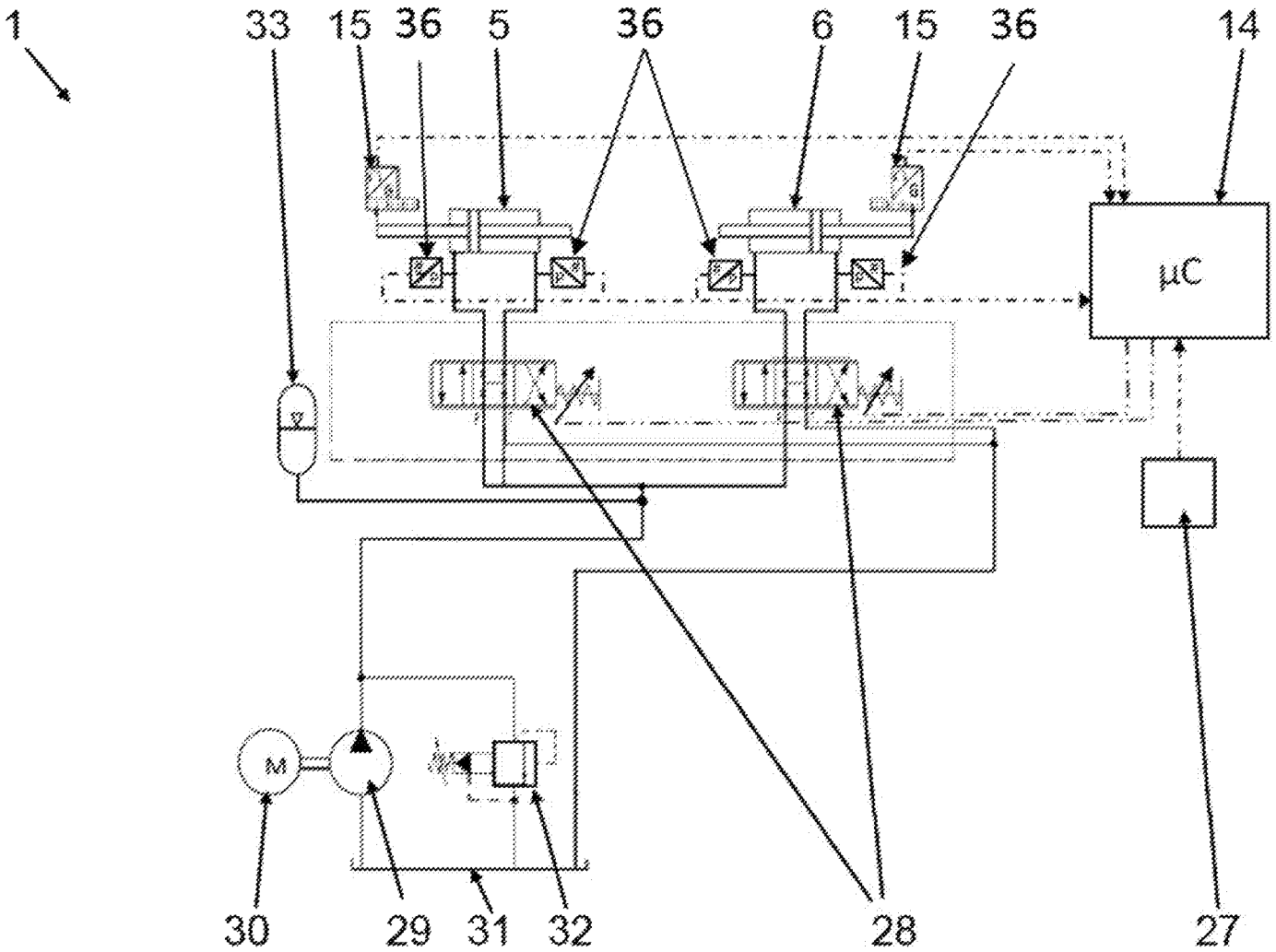
Figure 15:
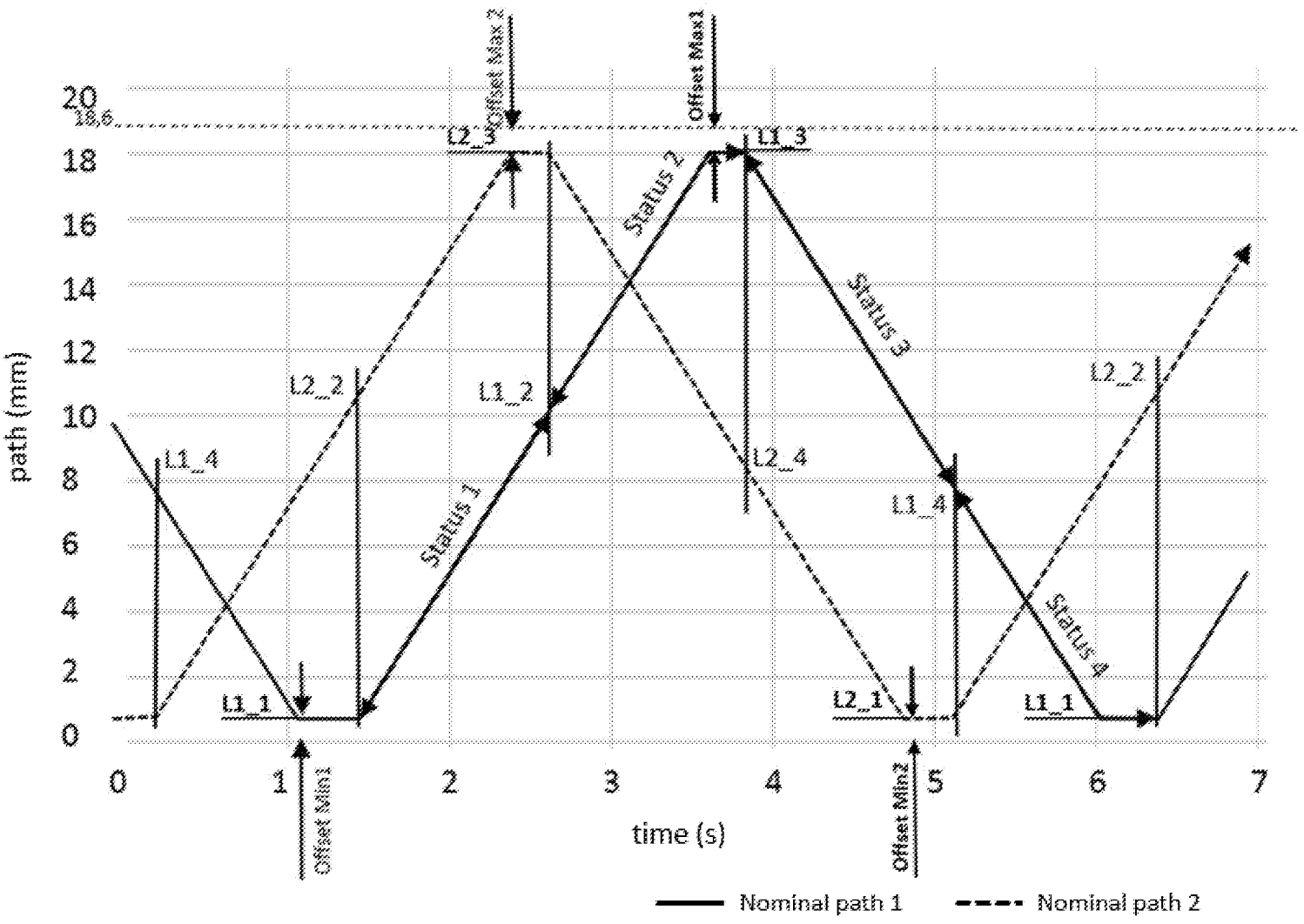
Figure 16:
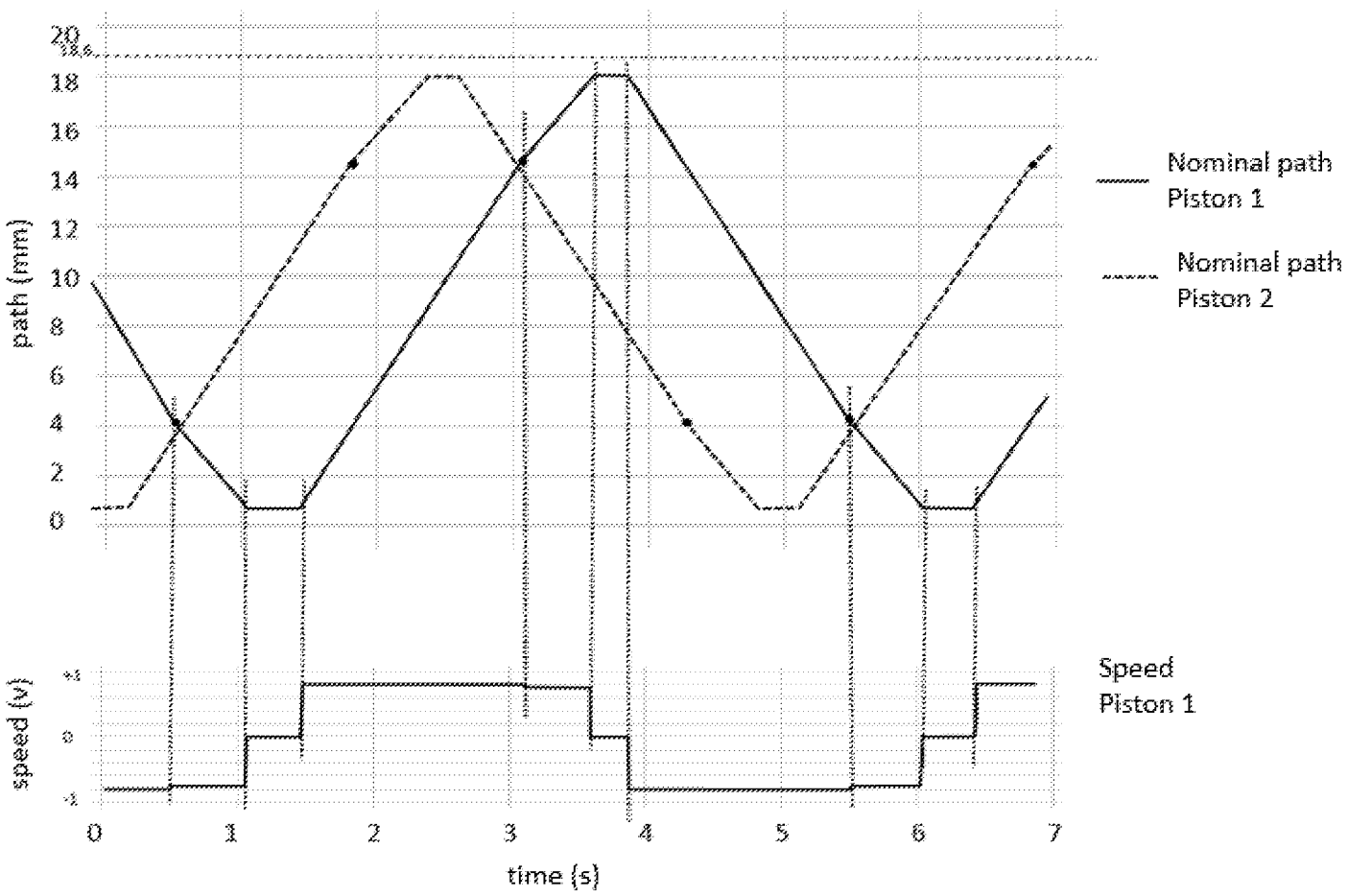
Figure 17:
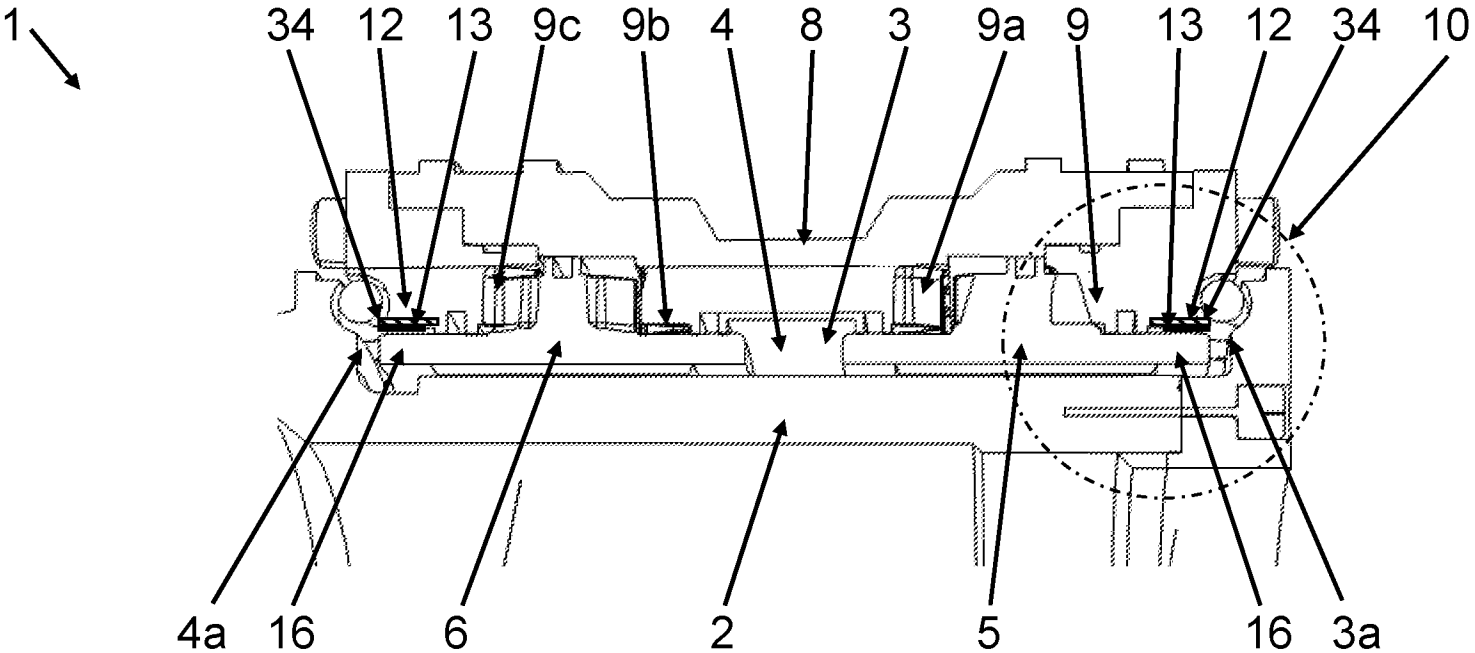
Figure 18:
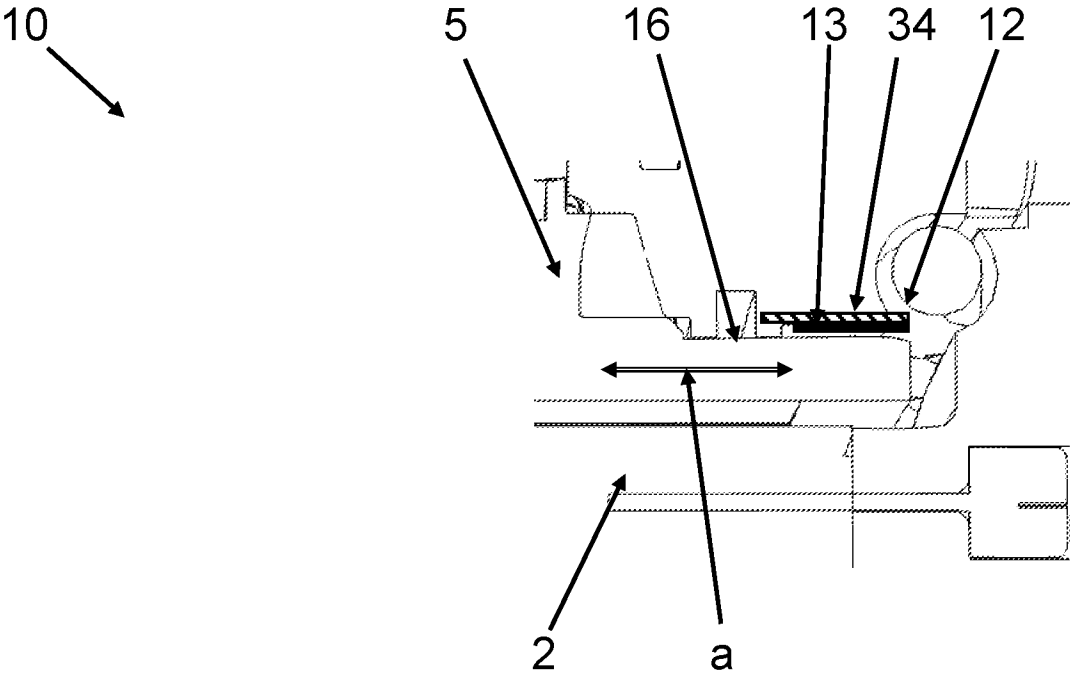
Figure 19:
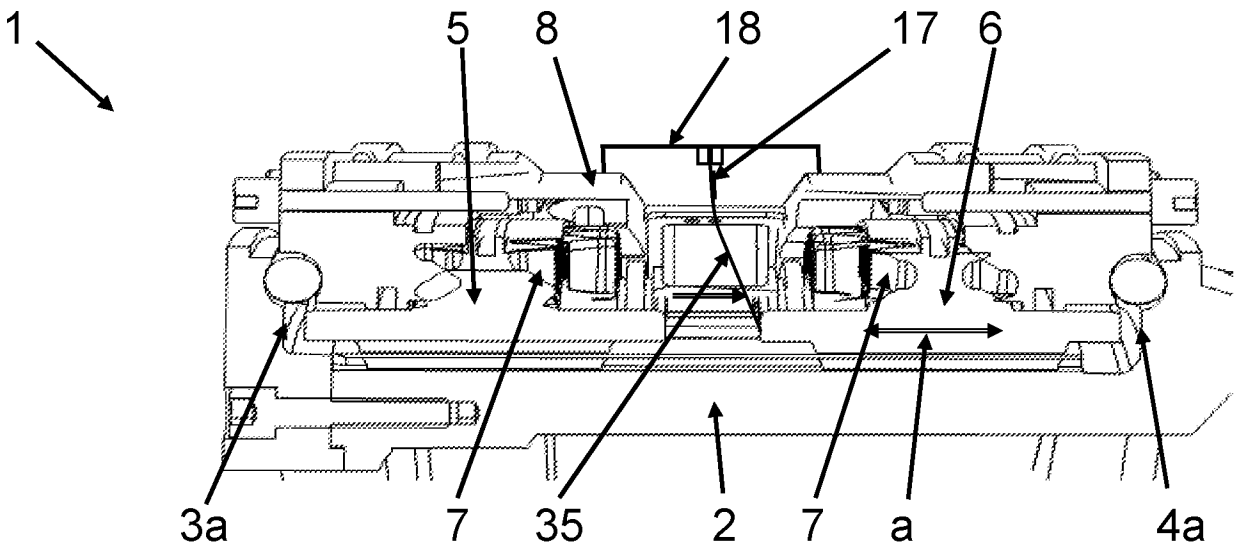
Figure 20:
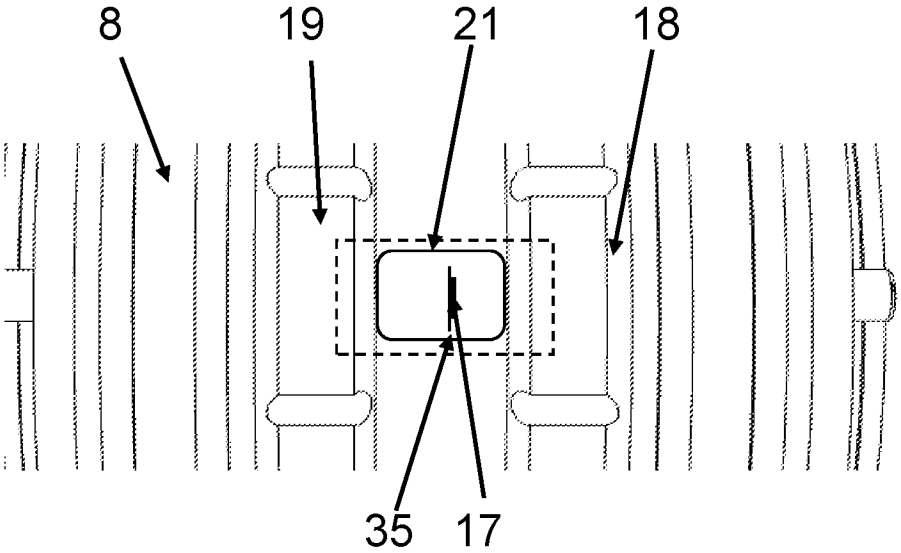

Further features, details and advantages of the invention are given in the following description and drawings. Examples of the execution of the invention are shown in the following drawings purely schematically and are described in more detail below. Objects or elements corresponding to each other are provided with the same reference signs in all figures. The figures showing:

FIG. 1: truck mounted concrete pump with large manipulator according to the invention, FIG. 2: boom section, FIG. 3: rotary drive according to the invention, FIG. 4: sectional view of rotary drive, FIG. 5: sectional view of rotary drive with end position switch, FIG. 6: sectional view of rotary drive with inductive end position switch, FIG. 7: exploded view of rotary drive, FIG. 8: sectional view of rotary drive, FIG. 9: rotary drive with feed through in cylinder housing, FIG. 10: side view of rotary drive, FIG. 11: sectional view through rotary drive, FIG. 12: detail in sectional view, FIG. 13: rotary drive side view, FIG. 14: hydraulic diagram for the control of rotary drive, FIG. 15: path-time diagram for control of the annular pistons, FIG. 16: path-time and speed diagram for control of the annular pistons, FIG. 17: sectional view of rotary drive with capacitive position sensor, FIG. 18: detail of sensor arrangement of the capacitive displacement sensor, FIG. 19: sectional view of rotary drive with strain gauges, FIG. 20: Top view of rotary drive with strain gauges.

In the figures marked with the reference symbol 1, a rotary drive 1 according to the invention is shown. The illustration according to FIG. 1 shows a truck-mounted concrete pump 200 with a large manipulator 100 carrying a concrete conveying line 201 (not shown here) (FIG. 2). The large manipulator 100 has an articulated boom 101, which comprises several boom sections 102, 102*a*, 102*b*. The boom sections 102, 102*a*, 102*b* of the articulated boom 101 are connected to the adjacent boom section 102, 102*a*, 102*b* or turntable 105 via articulated joints 103, 103*a*, 103*b*, 103*c* (FIG. 2) by means of a drive 1 each (FIG. 3), 1*a*, 1*b*, 1*c*, 1 pivotable to each other. This allows the articulated boom 101 of the large manipulator 100 to be folded out and folded in on the truck-mounted concrete pump 200. Before the articulated boom 100 is unfolded, 200 fold-out or extendable supports 202 are extended or unfolded from the vehicle profile of the truck-mounted concrete pump 200. In the example embodiment shown here, the drives 1*a*, 1*b* are designed as hydraulic cylinders acting on lever gears. A rotary drive 1 (FIG. 3) is arranged on the third boom section 102*b* and the fourth boom section 102C of the articulated boom 101 shown here, which enables a swivelling movement between the third boom section 102*b* and the fourth boom section 102*c*.

FIG. 2 shows the third boom section 102*b* with a holder 106 for shaft 2 (FIG. 3) of the rotary drive 1 (FIG. 3) located in the articulated joint 103*c*. FIG. 2 shows that the concrete conveying line 201 routed along the boom section 102*b* is guided in the area of the articulated joint 103*c* by the rotary drive 1 (FIG. 3). The rotary drive 1 located at the articulated joint 103*c* between the third boom section 102*b* and the fourth boom section 102*c* can be seen in FIG. 3. This rotary drive 1 (FIG. 3) can also be arranged on the other articulated joints 103, 103*a*, 103*b* (FIG. 1) of the articulated boom 101 and there allow a swivelling of the boom sections 102, 102*a*, 102*b* (FIG. 1) towards each other or of the first boom section 102 (FIG. 1) towards the turntable 105 (FIG. 1). Also at the articulated joints 103, 103*a*, 103*b*, 103*c* (FIG. 1) of the articulated boom 101 (FIG. 1) rotary drives 1 (FIG. 3) can be provided.

The rotary drive 1 shown in FIG. 3 has a shaft 2, which is supported in a cylinder housing 8. On the outer side 19 of the cylinder housing 8 an additional housing 18 can be seen, for the arrangement of a sensor 15 (FIG. 4) to detect the position of the annular pistons 5, 6 (FIG. 4).

The annular pistons 5, 6 can be seen in FIG. 4, which is a sectional view of the rotary drive 1 shown in FIG. 3. The annular pistons 5, 6 are non-rotatably connected to the shaft 2 and can be moved on the shaft 2 in the direction of the shaft axis between each of two end positions 3, 3*a*, 4, 4*a* along a sliding path a (FIG. 19) by pressurisation with hydraulic fluid. Each of the annular pistons 5, 6 has two annular spur serrations 7, 7*a* (FIG. 7) directed away from each other, which can be seen particularly well in FIG. 7. In the cylinder housing 8 of the rotary drive 1 there are ring type serrations 9 (FIG. 7), 9*a* (FIG. 17), 9*b*, 9*c* (FIG. 7) arranged in addition to the spur serrations 7, 7*a* (FIG. 7) of the annular pistons 5, 6. The spur serrations 7, 7*a* (FIG. 7) of the annular pistons 5, 6 can be brought into and out of engagement with the ring type serrations 9 (FIG. 7), 9*a* (FIG. 17), 9*b*, 9*c* (FIG. 7) of the cylinder housing 8 by moving the annular pistons 5, 6 along the sliding path a (FIG. 19). A control unit 14 (FIG. 14) controls the supply of hydraulic fluid to the annular pistons 5, 6, whereby the control unit 14 (FIG. 14) is designed to cause a reciprocating movement of the annular pistons 5, 6 on the shaft 2 according to an operating signal. FIG. 4 also shows a sensor arrangement 10 for detecting the position of the annular pistons 5, 6 along the sliding path a (FIG. 19). A displacement sensor 15 of this sensor arrangement 10 is arranged in an additional housing 18 arranged on the outside 19 of the cylinder housing 8.

FIG. 5 shows a special embodiment of the rotary drive 1. The rotary drive 1 shown here differs from the rotary drive 1 according to FIG. 4 in that the sensor arrangement 10 for detecting the position of the annular pistons 5, 6 along the slide path a (FIG. 19) is located inside the cylinder housing 8 and not outside. The sensor arrangement 10 arranged inside the cylinder housing 8 comprises several switches 11 which switch when a predetermined position of the respective annular piston 5, 6 is reached. This allows the position of the annular pistons 5, 6 to be detected at a predetermined position along the respective sliding path a (FIG. 19). When a predetermined position of the annular pistons 5, 6 is reached, the control unit 14 (FIG. 14) can control the pressurisation of the annular pistons 5, 6 with hydraulic fluid in such a way that the changeover phase is initiated during the back and forth movement of the annular pistons 5, 6 on shaft 2. The switches 11 are arranged in the area of the respective end position 3, 3*a*, 4, 4*a* for the reciprocating movement of the annular pistons 5, 6 on the shaft 2. Hereby load peaks on the tooth tips of the ring type serrations 9 (FIG. 7), 9*a* (FIG. 17), 9*b*, 9*c* (FIG. 7) and spur serrations 7, 7*a* (FIG. 7) can easily be avoided.

FIG. 6 shows another special embodiment of the rotary drive 1. The rotary drive 1 shown here differs from the rotary drive 1 according to FIG. 4 and FIG. 5 in that the switches 11, which switch when the respective annular piston 5, 6 reaches a predetermined position, are designed as inductive limit switches 11. Such inductively switching limit position switches 11 provide a reliable and low-wear possibility of reliably detecting the position of the annular pistons 5, 6 along the sliding path a (FIG. 19) when a predetermined position is reached.

FIG. 7 shows a disassembled rotary drive 1 in an exploded view. The cylinder housing 8 of rotary drive 1 is shown in the centre of this illustration. This cylinder housing 8 has on the inside complementary ring type serrations 9, 9*a* (FIG. 17) 9*b*, 9*c* to the spur serrations 7, 7*a* of the annular pistons 5, 6. The spur serrations 7, 7*a* of the annular pistons 5, 6 can be engaged and disengaged by moving the annular pistons 5, 6 on the shaft 2 shown on the right hand side. The cylinder housing 8 shown here also comprises two additional cylinder housing parts 8*a*, 8*b*, which are equipped with ring type serrations 9, 9*c* complementary to the spur serrations 7*a* of the annular pistons 5, 6. The spur serrations 7, 7*a* of the annular pistons 5, 6 can also be engaged and disengaged with the complementary ring type serrations 9, 9*c* in the two additional cylinder housing parts 8*a*, 8*b* by moving the annular pistons 5, 6 on the shaft 2. In order to enable a movement of the annular pistons 5, 6 along a sliding path a (FIG. 19) on the shaft 2 between two end positions 3, 3*a*, 4, 4*a* (FIG. 11) in each case, the shaft 2 has a slide serration 22 running in the axial direction. The annular pistons 5, 6 have on the inside a slide serration 23 complementary to the slide serration 22 of shaft 2. With the movement of the annular pistons 5, 6 on the shaft 2 and the engagement and disengagement of the annular gears 9, 9*a* (FIG. 17) 9*b*, 9*c* and the spur serrations 7, 7*a*, a rotary movement of the cylinder housing 8 relative to the shaft 2 can be generated. To secure the shaft 2 of the rotary drive 1 in the cylinder housing 8, a face flange 24 is also provided which secures the shaft 2 in the cylinder housing 8 by screwing it to the shaft 2. FIG. 7 also shows that the cylinder housing 8 has a feed-through 21, which is used to detect the position of the annular pistons 5, 6 outside the cylinder housing 8.

FIG. 8 shows an assembled rotary drive 1, with two additional housings 18 on the outside 19 in the area of the feed-through 21 (FIG. 7) on the cylinder housing 8. In the openly shown additional housings 18 the displacement sensors 15 can be recognised with which the momentary position of the annular pistons 5, 6 (FIG. 7) along the sliding path a (FIG. 19) can be recorded outside the cylinder housing 8. These displacement sensors 15 can be designed inductive or capacitive or according to any other displacement measuring principle known to the expert.

In FIG. 9 the rotary drive 1 is shown according to FIG. 8 without the additional housings 18 (FIG. 8) on the outside 19 of the cylinder housing 8. This shows that the feed-through 21 in the cylinder housing 8 are designed as slotted holes running in the direction of the sliding path a (FIG. 19).

FIG. 10 shows a side view of rotary drive 1 according to FIG. 8, showing that shaft 2 of rotary drive 1 is hollow, thus making it possible, for example, to guide a concrete conveying line 201 (FIG. 2) through shaft 2. FIG. 10 shows a cutting plane A-A through the cylinder housing 8 and an additional housing 18 arranged on the outside 19.

FIG. 11 shows a sectional view of rotary drive 1 according to the sectional plane A-A shown in FIG. 10. FIG. 11 shows that the displacement sensor 15 located in the additional housing 18 detects the momentary position of the right hand annular piston 5 along the sliding path a (FIG. 12) on the shaft 2 outside the cylinder housing 8. For this purpose the displacement sensor 15 is connected to a sensing rod 20 which is guided through the feed-through 21 into the cylinder housing 8. It can be seen that the sensing rod 20 is engaged with the right-hand annular piston 5. Hereby the momentary position of the annular piston 5 can be transmitted via the rod 20 to the displacement sensor 15 in the additional housing 18. A detailed view of the sensor arrangement 10 shown here is shown in FIG. 12.

FIG. 12 shows that the sensing rod 20 in the additional housing 18 is guided in a guide 25. The reciprocating movement of the annular piston 5 on the sliding path a causes a displacement of the rod 20 in engagement with the annular piston 5. This displacement causes the rod 20 to move back and forth in the slotted hole 21 and thus transmits the movement of the right annular piston 5 along the sliding path a to the additional housing 18. In the additional housing 18 a pressure spring 26 is provided which ensures that the rod 20 remains in engagement with the annular piston 5. The movement of the rod 20 on the guide 25 is transmitted to the displacement sensor 15, so that the latter can record the current position of the annular piston 5 along the sliding path a. For the left hand annular piston 6 a corresponding sensor arrangement is arranged in an additional housing 18 (FIG. 8) as shown in FIG. 8.

FIG. 13 shows the two displacement sensors 15 in the additional housings 18. It can be seen that the sensing rod 20 is in engagement with the respective annular pistons 5, 6 to detect the current position of the respective annular pistons 5, 6. For this purpose the cylinder housing 8 (FIG. 8) is not shown in the illustration according to FIG. 13. As shown here, the sensing rods 20 can engage with one end on the piston shoulder of the respective annular piston 5, 6 or for example also be guided in a groove on the piston shoulder.

FIG. 14 shows a simplified hydraulic diagram for the control of the two annular pistons 5, 6 (FIG. 13) of the rotary drive 1 (FIG. 3). The displacement sensors 15, 17 (FIGS. 13 and 19), which detect the actual position of the annular pistons 5, 6 along the sliding path a (FIG. 12), are connected to the control unit 14 which controls the hydraulic fluid supply to the annular pistons 5, 6 (FIG. 13). The control unit 14 is set up to effect the reciprocating movement of the annular pistons 5, 6 (FIG. 13) on the shaft 2 (FIG. 7) according to an operation signal. This operating signal can be effected via an input unit 27, via which, for example, the speed of the rotary movement of the cylinder housing 8 (FIG. 7) relative to shaft 2 (FIG. 7) but also the direction of rotation can be set. The pressurisation of the annular pistons 5, 6 (FIG. 11) with hydraulic fluid is achieved via electrically actuated proportional valves 28 with which the control unit 14 is connected. The proportional valves 28 are supplied with hydraulic fluid via a hydraulic pump 29. The hydraulic pump 29 is preferably driven via the drive motor 30 of the truck-mounted concrete pump 200 (FIG. 1). The hydraulic fluid delivered via the hydraulic pump 29 is fed from a hydraulic tank 31. The system shown also has a constant pressure control 32, with which a constant pressure is set at the proportional valves 28. To improve the constant pressure at the proportional valves 28, a hydraulic accumulator 33 can also be placed close to the proportional valves 28. By means of the proportional valves 28, the speeds of the annular pistons 5, 6 can be controlled in a closed circuit, depending on their respective position. This considerably improves the uniformity of the rotary drive's rotational movement compared with a control disc control system in which only the direction of the hydraulic flow is changed at the changeover points.

If the rotary drive 1 (FIG. 3) is operated under closed-loop control, the movement of the annular pistons 5, 6 (FIG. 7) must be constantly recorded and updated. Four movement sections (status 1 to status 4) are shown graphically in FIG. 15. The same division applies to both annular pistons 5, 6 (FIG. 7). The movement sections are defined by values which can be changed by a teaching program. For the clockwise rotation and the counterclockwise rotation of shaft 2 (FIG. 7) relative to cylinder housing 8 (FIG. 7), these movement sections are also assigned similarly, but in reverse order. With the values "L1_1+OffsetMin1", "L1_3−OffsetMax1" or the values "L2_1+OffsetMin2", "L2_3−OffsetMax2" the stroke of the annular piston 5, 6 (FIG. 7) is limited or the movement is stopped. With the values "L1_2", "L1_4" or the values "L2_2", "L2_4" the respective other annular piston 5, 6 (FIG. 7) starts moving again. In this diagram, in particular also standstill times or phases of lower speeds of the annular pistons 5, 6 in the area of the end stops can be seen. These serve to ensure that the annular pistons 5, 6 do not start up again immediately at the time of the travel change-over, but first wait until the tips of the ring spur serration teeth 9, 9*a* are pushed further by the annular pistons in motion, so that the spur serration teeth 7, 7*a* of the annular piston 5 or 6 and the ring type serration teeth 9, 9*a* engage in the next tooth gap. This type of control is particularly easy to implement with the sensor systems explained in connection with FIGS. 5 and 6.

FIG. 16 also shows a path-time diagram for the control of the annular pistons 5, 6 (FIG. 7), as well as a corresponding speed diagram for one of the annular pistons, in which the continuous detection of the position of the annular pistons 5, 6, as explained above, is advantageous. Both annular pistons 5, 6 (FIG. 7) have a maximum sliding path from end stop to end stop of 18.6 mm. However, this maximum sliding path is not fully utilised. Instead, the annular pistons 5, 6 (FIG. 7) stop approx. 0.3 mm before the end stops. As long as there is the danger that the tooth tips of the spur serrations 7, 7*a* (FIG. 7) of the annular pistons 5, 6 (FIG. 7) engage with the tooth tip of the ring type serrations 9 (FIG. 7), 9*a* (FIG. 17), 9*b*, 9*c* (FIG. 7) in the cylinder housing 8 (FIG. 7), the respective annular piston 5, 6 (FIG. 7) will briefly stop on the sliding path a or the speed of the respective annular piston is reduced until the other annular piston 5, 6 (FIG. 7) has pushed the ring type serration 9 (FIG. 7), 9*a* (FIG. 17), 9*b*, 9*c* (FIG. 7) in the cylinder housing 8, 8*a*, 8*b* (FIG. 7) so far that the ring type serration 9 (FIG. 7), 9*a* (FIG. 17), 9*b*, 9*c* (FIG. 7) and spur serration do not mesh point on point and with sufficient material thickness. After having come to a standstill on the sliding path a (FIG. 19) and before engaging, the annular pistons 5, 6 (FIG. 7) first travel at a slightly higher speed along the sliding path a (FIG. 19), while the speed of the other annular piston is slightly reduced in order to take over the drive load in a defined manner. By skillful control of the speeds of the annular pistons 5, 6 the uniformity of the rotary movement of the rotary drive can thus be optimised. The diagram shown in FIG. 16 and described above is particularly relevant when lifting the next boom section. When lowering the boom section, the control can be applied in reverse.

The load transfer points and the resulting change in piston speed can be defined even better if the hydraulic oil pressures in the cylinder chambers are considered.

For this purpose, as shown in FIG. 14, two pressure sensors 36 are arranged on each of the annular piston A 5 and annular piston B 6 to measure the hydraulic pressure acting on the annular pistons. The load acting on the rotary drive, which is dependent on the position of the boom section 102*a*, 102*b*, for example, can be determined by means of the pressure sensors 36 via the pressure difference of the two pressure sensors 36 assigned to one annular piston 5, 6 and used for the optimization of the load transfer points.

FIG. 17 shows another special version of the rotary drive 1 with a capacitive sensor arrangement 10. In the version shown here, the displacement sensor 12, which detects the instantaneous position of the respective annular piston 5, 6, has an annular electrode in the form of an insulated metallic ring 13, insulated from the cylinder housing 8. A section 16 of the annular piston 5, 6 detected by the displacement sensor 12 dips into this annular electrode 13 to different depths when displaced along the sliding path a (FIG. 18). By this the momentary position of the annular piston 5, 6 along the sliding path a (FIG. 18) can be simply capacitively recorded. Depending on the immersion depth of the section 16 in the area of the ring electrode 13, a changed capacitance can be measured at the ring electrode 13. As can be seen in FIG. 17, the ring electrode 13 is insulated from the cylinder housing 8 by a plastic ring 34. In addition, an air gap is formed between the immersing section 16 of the annular piston 5, 6 and the ring electrode 13, providing insulation of the ring electrode 13 from the immersing section 16. Both the right annular piston 5 and the left annular piston 6 are detected by such a capacitive displacement sensor 12.

FIG. 18 shows a detailed view from FIG. 17, where the sensor arrangement 10 can be seen more clearly. The ring electrode 13 is located between the plastic ring 34 and the annular piston 5. When the annular piston 5 is moved along the sliding path a, the section 16 dips to different depths into the ring electrode 13 which is insulated from the cylinder housing 8. This changes the capacitance at the ring electrode 13 and the momentary position of the annular piston 5 on the sliding path a and can be measured contactlessly via the ring electrode 13.

FIG. 19 shows another special version of the rotary drive 1. Here the displacement sensor 17, which can detect the momentary position of an annular piston 6 along the sliding path a, is equipped with a strain gauge 17. This strain gauge 17 provides a signal dependent on the momentary position of the annular piston 6 along the sliding path a. This is achieved by mounting the strain gauge 17 on a pretensioned bending spring 35 which engages with the annular piston 6 to detect its momentary position. Due to the pretension of the bending spring 35, it is remains in engagement with the annular piston and the resistance of the strain gauge 17 changes when the bending of the bending spring 35 changes, so that the momentary position of the annular piston 6 can be detected along the sliding path a. As shown, one end of the preloaded bending spring 35 rests on the piston shoulder of the right-hand annular piston 6, but it can also be guided in a groove on piston 6. To record the momentary position of the left-hand annular piston 5 on the sliding path a (FIG. 12), a corresponding path sensor with a strain gauge 17 and preferably a bending spring 35 can also be provided here.

FIG. 20 shows a top view of the displacement sensor as shown in FIG. 19, showing how the strain gauge 17 and the bending spring 35 are guided through the feed through 21 into the cylinder housing 8.

REFERENCE SIGNS

1 Rotary drive
2 First rotary drive element (shaft)
3 3*a* End position
4 4*a* End position
5 Annular piston A
6 Annular piston B
7 7*a* spur serrations
8 8*a*, 8*b* second rotary drive element (cylinder housing)
9 9*a*, 9*b*, 9*c* ring type serrations
10 Sensor arrangement
11 Switch
12 Displacement sensor
13 Ring electrode
14 Control unit
15 Displacement sensor
16 Section
17 Strain gauge
18 Additional housing
19 Outside
20 Sensing rod
21 Feed through
22 Slide serration
23 Inner slide serration
24 Face flange
25 guide
26 pressure spring
27 input unit
28 Proportional valve
29 Hydraulic pump
30 Drive engine

31 Hydraulic tank
32 Constant pressure control
33 Hydraulic accumulator
34 Plastic ring
35 Bending spring
36 Pressure sensor
100 Large manipulator
101 Articulated boom
102 102*a*, 102*b* boom sections
103 103*a*, 103*b*, 103*c* articulated joints
104 Vertical axis
105 turntable
106 reception
200 truck mounted concrete pump
201 concrete conveying line
202 Outrigger

The invention claimed is:

1. A hydraulic rotary drive comprising:

a first rotary drive element;

annular pistons connected to the first rotary drive element in a rotationally fixed manner and configured to be axially movable on the first rotary drive element between two end positions along a sliding path by being acted upon by hydraulic fluid, each annular piston having two annular spur serrations directed away from one another;

a second rotary drive element with ring type serrations complementary to the spur serrations of the annular pistons, wherein the spur serrations of the annular pistons are engageable and disengageable with the associated annular ring type serrations of the second rotary drive element by moving the annular pistons on the first rotary drive element thereby causing rotary movement of the second rotary drive element relative to the first rotary drive element;

a control unit configured to control supply of the hydraulic fluid to the annular pistons, wherein the control unit is configured to cause a reciprocating movement of the annular pistons on a shaft in accordance with an operating signal; and a sensor arrangement communicatively coupled to the control unit and arranged to detect the positions of the annular pistons along the respective sliding paths and generate sensor signals, wherein the control unit is configured to regulate speed of the annular pistons as a function of the sensor signals of the sensor arrangement.

2. The hydraulic rotary drive of claim 1, wherein the sensor arrangement is arranged to detect the positions of the annular pistons when the respective end positions are reached.

3. The hydraulic rotary drive of claim 1, wherein the sensor arrangement comprises a switch configured to switch when predetermined positions of the respective annular pistons are reached.

4. The hydraulic rotary drive of claim 3, wherein the switch is an inductive limit position switch.

5. The hydraulic rotary drive of claim 1, wherein the sensor arrangement comprises at least one displacement sensor configured to detect an instantaneous position of at least one of the annular pistons along its respective sliding path.

6. The hydraulic rotary drive of claim 5, wherein the displacement sensor is an inductive sensor.

7. The hydraulic rotary drive of claim 5, wherein the displacement sensor is a capacitance sensor.

8. The hydraulic rotary drive of claim 7, wherein the displacement sensor has an annular electrode which is insulated from a cylinder housing and into which at least a section of at least one of the annular pistons detected by the displacement sensor is immersed to different depths during displacement along the respective sliding path.

9. The hydraulic rotary drive of claim 5, wherein the displacement sensor comprises a strain gauge configured to supply a signal dependent on the instantaneous position of the at least one annular piston along the respective sliding path.

10. The hydraulic rotary drive of claim 5, wherein the displacement sensor is arranged outside either the first rotary drive element or the second rotary drive element.

11. The hydraulic rotary drive of claim 10, wherein the displacement sensor is arranged in an additional housing which is arranged on an outside of either the first rotary drive element or the second rotary drive element.

12. The hydraulic rotary drive of claim 10, wherein the displacement sensor is configured to detect the instantaneous position of the at least one annular piston along the respective sliding path in either the first rotary drive element or the second rotary drive element via a sensing rod, the sensing rod being guidable into either the first rotary drive element or the second rotary drive element through a feed-through.

13. The hydraulic rotary drive of claim 12, wherein the sensing rod is engaged with the at least one annular piston.

14. The hydraulic rotary drive of claim 1, wherein the first rotary drive element is a shaft and the second rotary drive element is a cylinder housing, the annular pistons being axially movable on the shaft between the respective two end positions along the respective sliding path by being acted upon by the hydraulic fluid.

15. A large manipulator comprising:

an articulated boom with two or more boom sections, wherein the boom sections are pivotally connected to the respective adjacent boom section via articulated joints via a hydraulic rotary drive, the hydraulic rotary drive comprising:

a first rotary drive element, annular pistons connected to the first rotary drive element in a rotationally fixed manner and configured to be axially movable on the first rotary drive element between two end positions along a sliding path by being acted upon by hydraulic fluid, each annular piston having two annular spur serrations directed away from one another, a second rotary drive element with ring type serrations complementary to the spur serrations of the annular pistons, wherein the spur serrations of the annular pistons are engageable and disengageable with the associated annular ring type serrations of the second rotary drive element by moving the annular pistons on the first rotary drive element thereby causing rotary movement of the second rotary drive element relative to the first rotary drive element, a control unit configured to control supply of the hydraulic fluid to the annular pistons, wherein the control unit is configured to cause a reciprocating movement of the annular pistons on the shaft in accordance with an operating signal, and a sensor arrangement communicatively coupled to the control unit and arranged to detect the positions of the annular pistons along the respective sliding paths and generate sensor signals, wherein the control unit is configured to regulate speed of the annular pistons as a function of the sensor signals of the sensor arrangement.

16. A truck-mounted concrete pump including the large manipulator of claim 15 carrying a concrete conveying line.

* * * * *